US006302065B1

(12) United States Patent
Davison

(10) Patent No.: US 6,302,065 B1
(45) Date of Patent: Oct. 16, 2001

(54) METHOD FOR MONITORING A COOLING SYSTEM

(75) Inventor: Lynn Edward Davison, Saline, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/525,385

(22) Filed: Mar. 15, 2000

(51) Int. Cl.[7] ..... F01P 5/14
(52) U.S. Cl. ..... 123/41.15; 73/198.1
(58) Field of Search ..... 73/118.1, 116, 73/117.3; 123/41.15, 198 D

(56) References Cited

U.S. PATENT DOCUMENTS

| | | | | |
|---|---|---|---|---|
| 4,274,381 | | 6/1981 | Abo . | |
| 4,402,217 | * | 9/1983 | Higashiyama | 73/117.3 |
| 4,534,214 | * | 8/1985 | Takahashi | 73/118 |
| 4,556,029 | | 12/1985 | Yamaguchi et al. . | |
| 5,551,396 | | 9/1996 | Suzuki et al. . | |
| 5,877,413 | * | 3/1999 | Hamburg et al. | 73/118.1 |
| 6,200,021 | * | 3/2001 | Mitsutani et al. | 374/1 |
| 6,240,774 | * | 6/2001 | Niki et al. | 73/118.1 |

* cited by examiner

*Primary Examiner*—Willis R. Wolfe
*Assistant Examiner*—Katrina B. Harris
(74) *Attorney, Agent, or Firm*—Julia Voutyras

(57) ABSTRACT

A method is presented for diagnosing an engine coolant temperature sensor and an engine thermostat. Engine coolant temperature is estimated based on engine operating conditions, such as engine speed, net engine torque, air flow, fuel-air ratio, exhaust gas temperature, etc., and a characteristic of the thermostat. The estimate is compared to the actual reading of the engine coolant temperature sensor in order to detect degradation in the performance of the sensor or the engine thermostat. If degradation is detected, the estimated engine coolant temperature can be used for various engine control strategies, such as electronic fuel injection, thereby improving vehicle performance, fuel efficiency, and emission control.

22 Claims, 3 Drawing Sheets

METHOD FOR MONITORING A COOLING SYSTEM

FIELD OF THE INVENTION

The present invention relates generally to systems for estimating engine coolant temperature in a vehicle equipped with an internal combustion engine, and more particularly, to using this information to determine whether the performance of the cooling system is degraded.

BACKGROUND OF THE INVENTION

Vehicle cooling systems typically have a coolant temperature sensor for providing coolant temperature information to the electronic engine controller and a thermostat for providing constant coolant temperature control. Coolant temperature is a very important parameter in several engine control strategies, and in particular in an electronically controlled fuel supply system. If the coolant temperature sensor is degraded, fuel consumption and emission strategy may be degraded. For example, if the coolant temperature sensor is indicating that the engine is cold, rather than warmed up, a rich fuel-air mixture may be supplied longer than necessary, thus potentially degrading emissions and fuel efficiency.

One method of diagnosing the engine coolant temperature sensor is described in U.S. Pat. No. 4,274,381. Engine coolant temperature is inferred from another temperature sensor such as the temperature sensor of the catalytic converter. This inferred value is compared to the value read by the coolant temperature sensor. If the two values are not the same, degradation is indicated. Then, a signal corresponding to the output of the engine coolant temperature sensor under normal engine operating conditions replaces the output of the degraded coolant temperature sensor.

The inventor herein has recognized a disadvantage with this approach. In particular, there is not a way to determine which one of the above mentioned sensors is degraded. Also, providing a predetermined signal to replace the degraded sensor information is not an accurate representation of the actual operating conditions, especially at high/low ambient temperatures, or at engine start-up.

Another disadvantage is that this method does not diagnose the cooling system thermostat. If the thermostat performance is degraded, efficient temperature levels will not be maintained under all operating conditions, and thus, vehicle performance, fuel efficiency and emission control may be degraded. Further, the prior art does not take into account the state of the thermostat (open or closed) when estimating coolant temperature.

SUMMARY OF THE INVENTION

An object of the present invention is to provide a method for diagnosing a cooling system in an internal combustion engine, and in particular to diagnosing the engine coolant temperature sensor and the thermostat.

The above object is achieved and disadvantages of prior approaches overcome by a method for diagnosing a cooling system having an engine coolant temperature sensor and a thermostat in an internal combustion engine, the method comprising: estimating an engine coolant temperature based on an operating condition and a characteristic of the thermostat; reading the engine coolant temperature sensor; comparing said estimate with said reading; and determining operability of the system based on said comparison.

An advantage of the above object of the invention is that a more precise method of diagnosing the engine coolant temperature sensor is developed. By taking into account a characteristic of the thermostat, it is possible to more accurately estimate coolant temperature since the cooling system performs differently depending on the operation of the thermostat. The electronic engine controller can use a more accurate estimate of the coolant temperature in case the coolant temperature sensor performance is degraded.

In another aspect of the present invention, a method for estimating an engine coolant temperature and diagnosing a coolant temperature sensor and a thermostat is developed. This method comprises determining a first estimate of heat added to the coolant based on an engine operating condition; determining a second estimate of coolant temperature based on said first estimate; reading the coolant temperature sensor; comparing said estimate with said reading; determining whether the coolant temperature sensor is functioning properly based on said comparing; and determining whether the thermostat is functioning properly based on said comparing. By using heat added to estimate coolant temperature, an accurate model is obtained to improve estimation. This ability contributes to improved vehicle performance, fuel efficiency and emissions control.

Other objects, features and advantages of the present invention will be readily appreciated by the reader of this specification.

BRIEF DESCRIPTION OF THE DRAWINGS

The objects and advantages of the invention claimed herein will be more readily understood by reading an example of an embodiment in which the invention is used to advantage with reference to the following drawings wherein:

DESCRIPTION OF THE INVENTION

Figure 1:
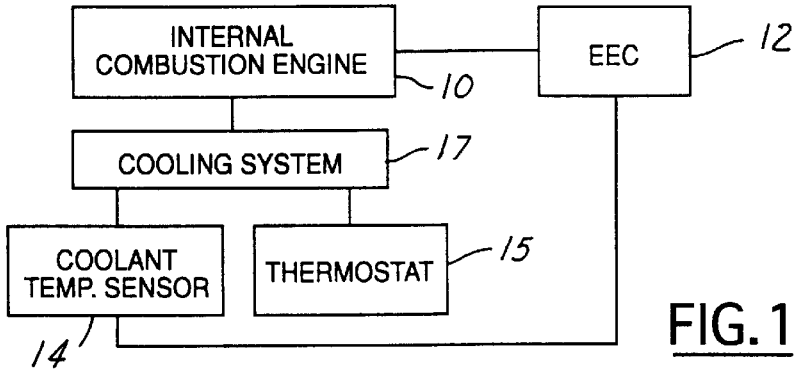
FIG. 1 is a block diagram of a vehicle illustrating various components related to the present invention.
Figure 2:
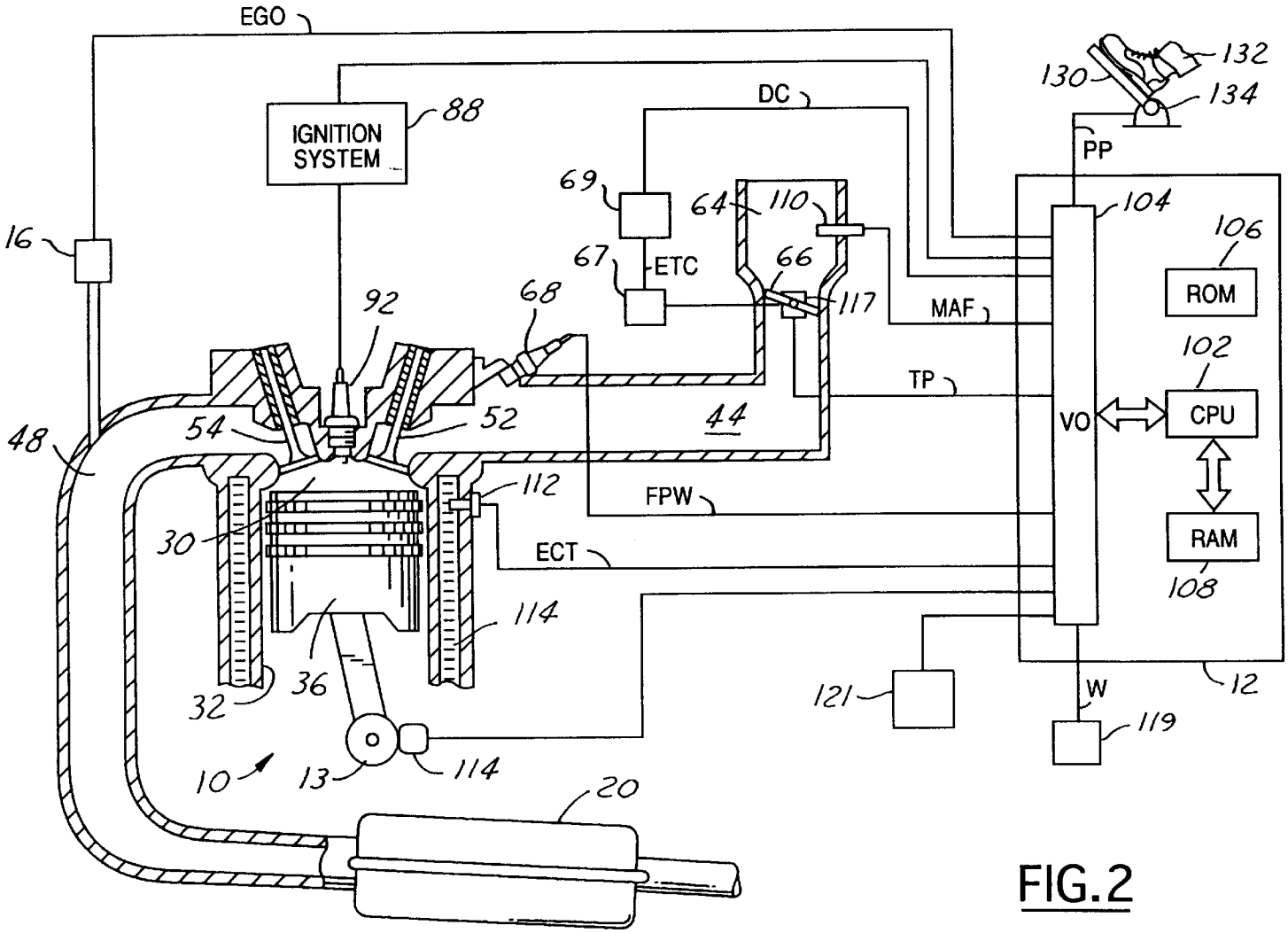
FIG. 2 is a block diagram of an engine in which the invention is used to advantage.

Referring to FIG. 1, an internal combustion engine 10, further described herein with particular reference to FIG. 2, is shown coupled to the electronic engine controller 12, and to the cooling system 17. Cooling system 17 is also coupled to a thermistor type engine coolant temperature sensor 14, and to a thermostat 15. The thermostat 15 opens when engine coolant temperature exceeds a predetermined high value to allow coolant to circulate and thus facilitate engine cooling. The coolant temperature sensor 15 is also coupled to the electronic engine controller 12. The information provided by the coolant temperature sensor is used in a variety of engine control strategies, such as emissions, fuel injection, etc.

Electronic engine controller 12 controls internal combustion engine 10 having a plurality of cylinders, one cylinder of which is shown in FIG. 2. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. In a preferred embodiment, sensor 16 is a HEGO sensor as is known to those skilled in the art.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width signal (fpw) from controller 12. Fuel is delivered to fuel injector 68 by a conventional fuel system (not shown) including a fuel tank, fuel pump, and fuel rail (not shown).

Engine 10 further includes conventional distributor-less ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of transmission shaft torque, or engine shaft torque from torque sensor 121, a measurement of turbine speed (Nt) from turbine speed sensor 119, where turbine speed measures the speed of shaft 17, and a profile ignition pickup signal (PIP) from Hall effect sensor 118 coupled to crankshaft 13 indicating an engine speed (Ne). Alternatively, turbine speed may be determined from vehicle speed and gear ratio.

Continuing with FIG. 2, accelerator pedal 130 is shown communicating with the driver's foot 132. Accelerator pedal position (PP) is measured by pedal position sensor 134 and sent to controller 12. In an alternate embodiment, throttle plate 66 communicates with the driver's foot through a mechanical linkage. The position of throttle plate 66 is measured by throttle position sensor 117, and sent to controller 12.

Figure 3:
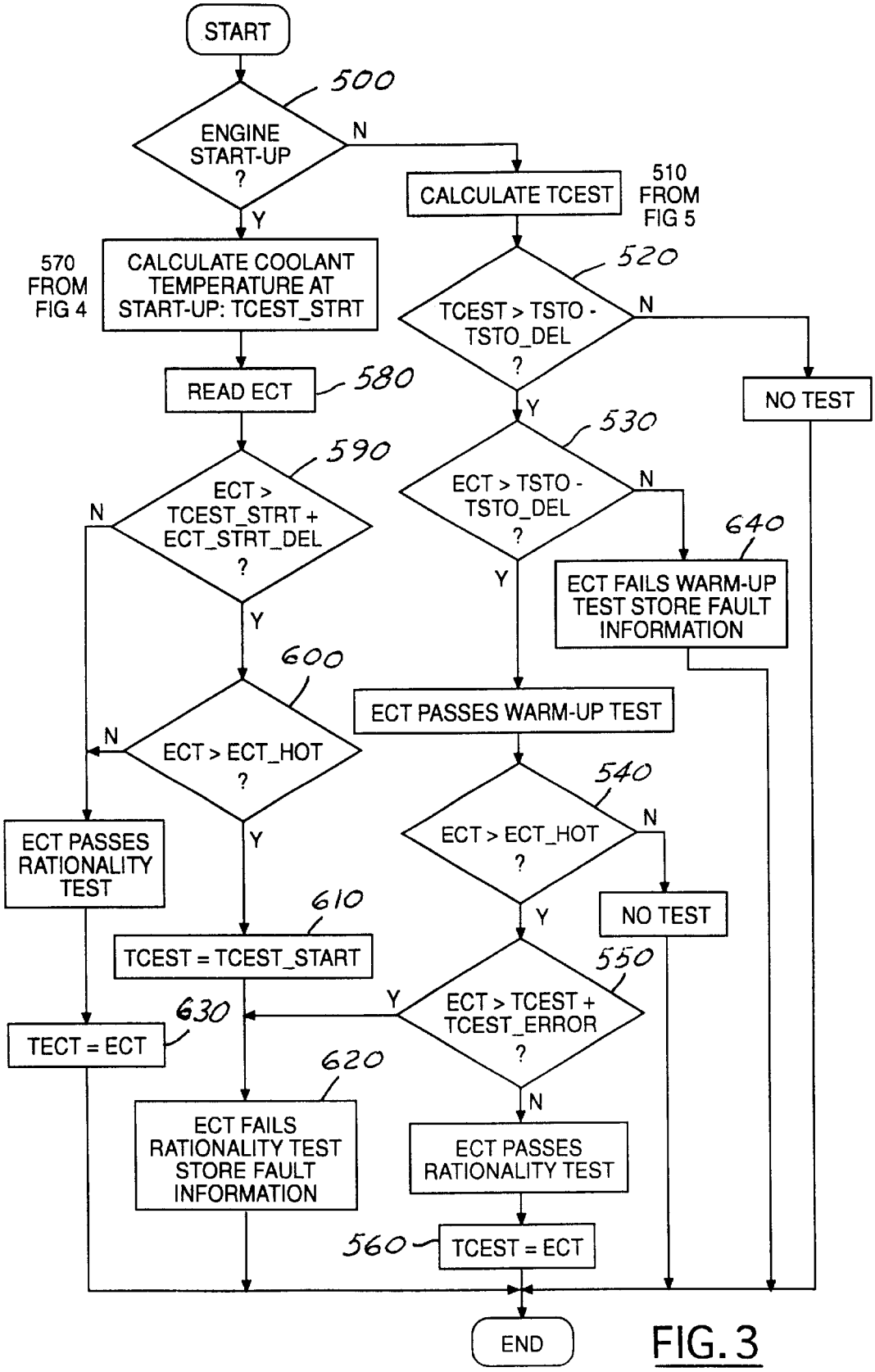

Referring now to FIG. 3, a routine is described for using the estimated engine coolant temperature value to diagnose the engine coolant temperature sensor and the thermostat. First, in step 500 a determination is made whether the vehicle has just been turned on (engine start-up). If the answer to step 500 is YES, estimated coolant temperature at start-up, TCEST_STRT is calculated in step 570 (see step 710 of FIG. 4). The routine then proceeds to step 580 where the value of the engine coolant temperature sensor, ECT, is read. Next, in step 590 a determination is made whether the value read by the sensor exceeds the estimated engine coolant temperature at engine start-up by a value larger than a preselected tolerance, ECT_STRT_DEL. If the answer to step 590 is NO, the engine coolant temperature sensor passes the rationality test and the routine is exited. If the answer to step 590 is YES, the routine proceeds to step 600, whereupon a decision is made whether the engine coolant temperature sensor reading exceeds a predetermined tolerance level, ECT_HOT. If the answer to step 600 is NO, the sensor passes the rationality test and the routine proceeds to step 630, whereupon the estimated value of the engine coolant temperature, TCEST, is seeded with the measured coolant temperature, ECT. The routine is exited. If the answer to step 600 is YES, the sensor does not pass the test and in step 610 the estimated value of the engine coolant temperature is set to be equal to the estimated value of the engine coolant temperature at engine start-up. The routine proceeds to step 620 whereupon a diagnostic code is set, and the routine is exited.

If the answer to step 500 is NO, the routine proceeds to step 510 whereupon the estimated value of the engine coolant temperature, TCEST, is calculated. The details of step 510 are described in FIG. 5. Next, in step 520, a decision is made whether the above estimated value exceeds the coolant temperature at which the thermostat is supposed to open by more than a predetermined tolerance amount. In other words, a decision is made whether the coolant temperature is high enough for the thermostat to open. If the answer to step 520 is NO, no thermostat test can be performed and the routine is exited. If the answer to step 520 is YES, a decision is made in step 530 whether the value read by the engine coolant temperature sensor exceeds the temperature at which the thermostat is supposed to open, TSTO, by more than a small predetermined tolerance. If the answer to step 530 is NO, the engine coolant temperature sensor does not pass the warm-up test, a diagnostic code is set in step 640 and the routine is exited. In other words, if the estimated engine coolant temperature is at the level at which the thermostat is supposed to open, and the temperature read by the coolant temperature sensor is below that value, a decision is made that either the sensor or the thermostat are not degraded, and a diagnostic code is set.

If the answer to step 530 is YES, the sensor passes the test, and the routine proceeds to step 540 whereupon a determination is made whether the engine coolant temperature sensor reading exceeds a predetermined tolerance level, ECT_HOT. If the answer to step 540 is NO, the routine exits. If the answer to step 540 is YES, the routine proceeds to step 550 where a determination is made whether the value read by the engine coolant temperature sensor exceeds the estimated value by larger than a small predetermined tolerance, TCEST_ERROR. If the answer to step 550 is YES, i.e., the value read by the sensor is significantly higher than the estimated value, a decision is made that the sensor is not functioning properly, and the routine proceeds to step 620 as described above. If the answer to step 550 is NO, the sensor is functioning properly and the routine proceeds to step 560 whereupon the value of estimated engine coolant temperature, TCEST, is set to be equal to the actual value read by the engine coolant temperature sensor, ECT. The routine then exits. If it is determined that the engine coolant temperature sensor is not functioning properly, the estimated coolant temperature value can be substituted to enable normal vehicle operation until service time. In that way, improved customer satisfaction as well as improved vehicle performance will be achieved.

Figure 4:
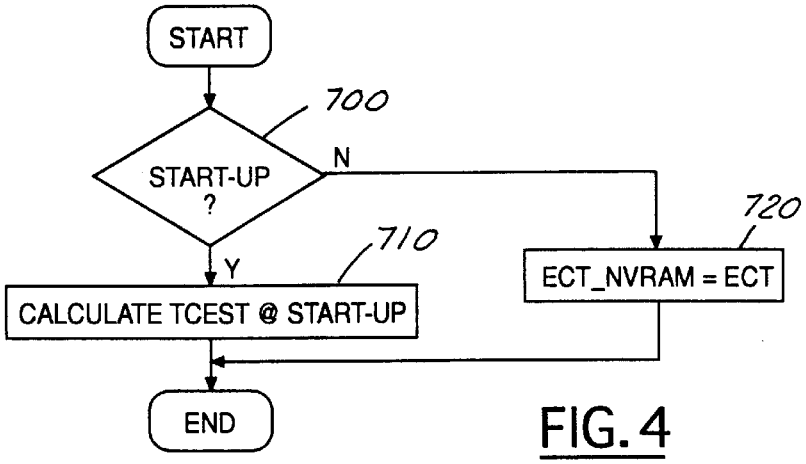
FIGS. 3, 4, and 5 are block diagrams of embodiments in which the invention is used to advantage.

Moving on to FIG. 4, a routine is described for calculating estimated engine coolant temperature at engine start-up. First, in step 700, a decision is made whether the engine has just started. If the answer to step 700 is YES, estimated engine coolant temperature at start-up, TCEST_STRT, is calculated in step 710 according to the following equation:

$$TCEST_STRT=(ECT_NVRAM-T0)*EXP(-SOAK_TIME/TAU)+T0,$$

where ECT_NVRAM is the engine coolant temperature stored in non-volatile memory, and corresponds to the engine coolant temperature at shutdown, T0 is ambient temperature, SOAK_TIME is engine off time, and TAU is an empirically derived time constant. This value is used in step 570 FIG. 3. The routine then exits. If the answer to step 700 is NO, the routine proceeds to step 720, whereupon the value read by the engine coolant temperature sensor is stored in non-volatile memory, and the routine is exited.

Figure 5:
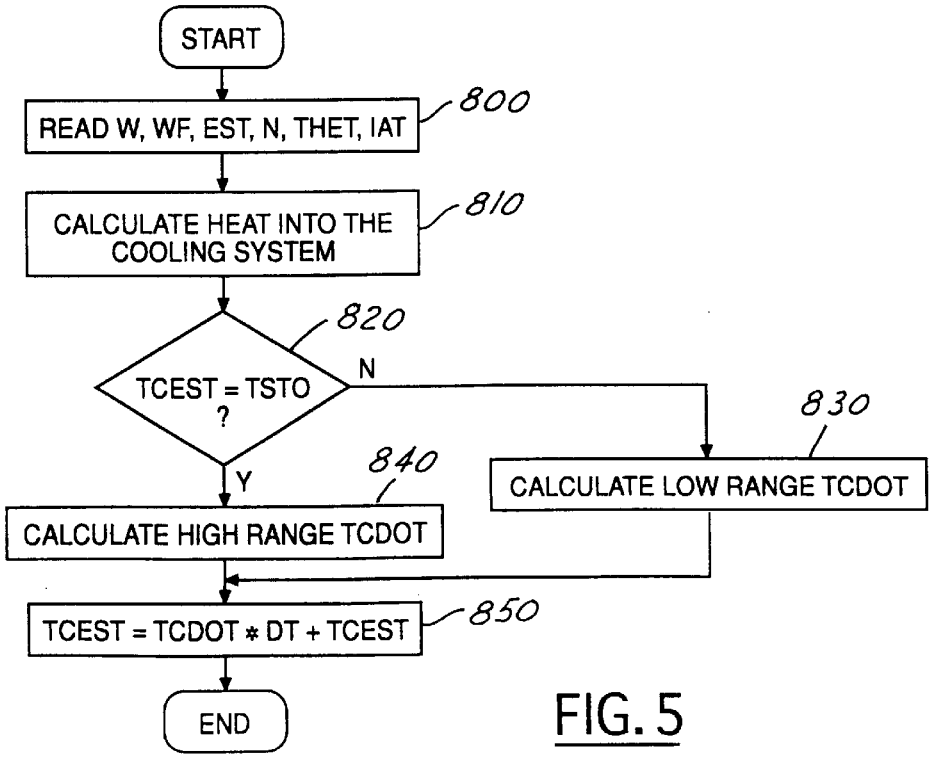

Referring now to FIG. 5, a routine is described for estimating engine coolant temperature based on the engine thermodynamic model. First, in step 800, engine parameters, such as air flow, W, fuel flow, WF, exhaust gas temperature, EGT, engine speed, N, net torque, TNET, and inlet air temperature, IAT, are read. Then, in step 810, heat transferred into the cooling system, QCDOT, is calculated according to the following equation:

$$QCDOT=WF*HFV-(W*CPA+WF*CPF)*(EGT-IAT)-N*TNET,$$

where HVF is the lower heating value of the fuel, CPA is the constant pressure specific heat of air, and CPF is the constant pressure specific heat of the fuel.

Next, in step 820 a determination is made whether the estimated value of the engine coolant temperature, TCEST, is larger than the threshold temperature at which the thermostat should start to open, TSTO. The initial value for TCEST comes from steps 620, FIG. 1. If the answer to step 820 is NO, i.e. the estimated coolant temperature is below the threshold at which the thermostat is supposed to start opening, the rate of change of coolant temperature, TCDOT, is calculated according to the low coolant temperature model. If the answer to step 820 is YES, the high coolant temperature model is used to estimate TCDOT in step 840. Once steps 830 or 840 are completed, the routine proceeds to step 850 where TCEST is calculated according to the following equation:

$$TCEST=TCDOT*DT+TCEST,$$

where DT is a predetermined time interval. The routine then exits.

This concludes the description of the invention. Engine thermodynamic properties, such as net torque, fuel-air ratio, engine speed, exhaust gas temperature, etc., are used to estimate the heat transfer to the cooling system. This estimate is used to estimate the rate of change in engine coolant temperature. Two different models are used depending on the characteristic of the thermostat. If the coolant temperature is above the threshold at which the thermostat is supposed to open, high range coolant temperature change rate is calculated. If the coolant temperature is below the threshold at which the thermostat is supposed to open, low range coolant temperature change rate is calculated. The estimated engine coolant temperature is then calculated by integrating the rate of change of coolant temperature over a period of time. This method provides an accurate estimate of engine coolant temperature by taking into account engine thermodynamic properties, as well as changes in the cooling system due to the characteristic of the thermostat. The reading of it by those skilled in the art would bring to mind many alterations and modifications without departing from the spirit and the scope of the invention. Accordingly, it is intended that the scope of the invention is defined by the following claims.

I claim:

1. A method for estimating an engine coolant temperature in a cooling system of an internal combustion engine having an engine coolant temperature sensor and a thermostat, the method comprising:

estimating the engine coolant temperature based on an operating condition;

comparing said estimate to a preselected threshold value;

adjusting said estimate based on a first parameter if said estimate is greater than said preselected threshold value; and adjusting said estimate based on a second parameter if said estimate is smaller than said preselected threshold value.

2. The method recited in claim 1 wherein said preselected threshold value is a temperature at which the thermostat starts to open.

3. The method recited in claim 1 wherein said operating condition is an engine operating condition.

4. The method recited in claim 3 wherein said engine operating condition is a fuel-air ratio.

5. The method recited in claim 3 wherein said engine operating condition is an engine speed.

6. The method recited in claim 3 wherein said engine operating condition is net torque.

7. The method recited in claim 1 wherein said preselected threshold value is a temperature at which the thermostat is supposed to open.

8. The method recited in claim 1 wherein said first parameter is a high operating range rate of the engine coolant temperature change.

9. The method recited in claim 1 wherein said second parameter is a low operating range rate of the engine coolant temperature change.

10. A method for diagnosing a cooling system having an engine coolant temperature sensor and a thermostat in an internal combustion engine, the method comprising:

estimating an engine coolant temperature based on an operating condition and a characteristic of the thermostat, wherein said characteristic of the thermostat is an open or closed state;

reading the engine coolant temperature sensor; comparing said estimate with said reading; and determining if the cooling system is functioning properly based on said comparison.

11. The method as cited in claim 10 wherein said operating condition is an engine speed.

12. The method as cited in claim 10 wherein said operating condition is an air-fuel ratio.

13. The method as cited in claim 10 wherein said operating condition is a net engine torque.

14. The method as cited in claim 10 wherein said comparison further comprises indicating when said estimate deviates from said reading by a predetermined amount.

15. The method recited in claim 10 wherein said determination further comprises indicating that the thermostat is degraded if said estimate is higher than said reading and higher than a specified temperature.

16. The method recited in claim 15 wherein said specified temperature is a temperature at which the thermostat starts to open.

17. The method recited in claim 10 wherein said determination further comprises indicating that the coolant temperature sensor is degraded if said estimate varies from said reading by a specified amount.

18. A method for estimating an engine coolant temperature and diagnosing a coolant temperature sensor and a thermostat, both coupled to an internal combustion-engine the method comprising:

determining a first estimate of heat added to the coolant based on an engine operating condition;

determining a second estimate of coolant temperature based on said first estimate, wherein said determining said second estimate further comprises integrating said first estimate with respect to time;

reading the coolant temperature sensor:

comparing said second estimate with said reading;

determining operability of the coolant temperature sensor based on said comparison; and determining operability of the thermostat based on said comparison.

19. A method for estimating an engine coolant temperature and diagnosing a coolant temperature sensor and a thermostat, both coupled to an internal combustion engine, the method comprising:

determining a first estimate of heat added to the coolant based on an engine operating condition;

determining a second estimate of coolant temperature based on said first estimate;

reading the coolant temperature sensor;

comparing said second estimate with said reading;

determining operability of the coolant temperature sensor based on said comparison;

determining operability of the thermostat based on said comparison; and using said second estimate in place of said reading when the coolant temperature sensor is degraded.

20. A method for estimating an engine coolant temperature and diagnosing a coolant temperature sensor and a thermostat, both coupled to an internal combustion engine, the method comprising:

determining a first estimate of heat added to the coolant based on an engine operating condition;

determining a second estimate of coolant temperature based on said first estimate;

reading the coolant temperature sensor:

comparing said second estimate with said reading, wherein said comparing further comprises indicating when said reading exceeds a specified threshold;

determining operability of the coolant temperature sensor based on said comparison; and determining operability of the thermostat based on said comparison.

21. A method for estimating an engine coolant temperature and diagnosing a coolant temperature sensor and a thermostat, both coupled to an internal combustion engine, the method comprising:

determining a first estimate of heat added to the coolant based on an engine operating condition;

determining a second estimate of coolant temperature based on said first estimate;

reading the coolant temperature sensor;

comparing said second estimate with said reading;

determining operability of the coolant temperature sensor based on said comparison;

determining operability of the thermostat based on said comparison; and indicating when said reading varies from said second estimate by a specified amount.

22. A method for estimating an engine coolant temperature and diagnosing a coolant temperature sensor and a thermostat, both coupled to an internal combustion engine, the method comprising:

determining a first estimate of heat added to the coolant based on an engine operating condition;

determining a second estimate of coolant temperature based on said first estimate;

indicating when said second estimate indicates a specified temperature above a specified threshold;

reading the coolant temperature sensor;

comparing said second estimate with said reading;

determining operability of the coolant temperature sensor based on said comparison; and determining operability of the thermostat based on said comparison.

* * * * *